United States Patent [19]

Givler

[11] 4,335,368

[45] Jun. 15, 1982

[54] DEAD CASE THERMOSTAT ASSEMBLY

[75] Inventor: Omar R. Givler, North Canton, Ohio

[73] Assignee: Portage Electric Products, Inc., North Canton, Ohio

[21] Appl. No.: 234,242

[22] Filed: Feb. 13, 1981

[51] Int. Cl.[3] ..... H01H 37/04; H01H 37/52

[52] U.S. Cl. ..... 337/372; 337/112; 337/380

[58] Field of Search ..... 337/380, 381, 372, 112, 337/113, 20, 34, 121, 186, 327, 398, 414, 101

[56] References Cited

U.S. PATENT DOCUMENTS

| | | | |
|---|---|---|---|
| 3,031,551 | 4/1962 | White et al. | 337/112 |
| 3,108,167 | 10/1963 | Prouty et al. | 337/101 |
| 3,148,258 | 9/1964 | Dales | 337/372 |
| 3,223,809 | 12/1965 | Wehl | 337/372 |

*Primary Examiner*—Harold Broome

*Attorney, Agent, or Firm*—McAulay, Fields, Fisher, Goldstein & Nissen

[57] ABSTRACT

A construction is provided for a dead case thermostat which allows for the operating parts and separators of the thermostat to be held in place, within the case, without crimping of the case and with little, if any, danger of breaking of the ceramic insulators.

7 Claims, 3 Drawing Figures

DEAD CASE THERMOSTAT ASSEMBLY

BACKGROUND OF THE INVENTION

In the assembly of small thermostats, it is well known to employ a plurality of contacts, actuating arms, and ceramic insulators which are placed within the thermostat case. The operating portions of the thermostat, including the contacts and bimetallic arm, are within the thermostat case, while the contact arms extend from the case. All of these components are within a "stack" at the open end of a case. Such a construction is shown, for example, in U.S. Pat. No. 3,223,809—Wehl, assigned to the same assignee as the present invention.

In some instances, a resinous insulating material, such as an epoxy resin, is used to seal the end of the case and this aids in holding the components in place within the "stack." In other cases, no such resinous material is employed. In that case, the parts within the stack must be held within the case by a friction fit. Even when an epoxy is employed, the parts must be held in place so that the epoxy can be correctly applied. Because of the ceramic members, friction fitting is more difficult than if all of the parts were metal. Crimping of the case, after insertion of the "stack" raises the possibility of cracking the ceramic insulating members. Precrimping of the case presents the same problem.

With a live case, one of the thermostat legs is against the case, and an indentation can be provided in this thermostat leg so that, upon insertion, the indentation acts as a spring to hold the "stack" within the case by a friction fit. In many cases, this friction fit is all that is desired or required, though in other cases, the epoxy, or other insulating resinous material can be placed at the opening of the thermostat case, adjacent the stack. Then, the indentation in the thermostat leg holds the various members in their proper position during application of the epoxy material.

With a dead case thermostat, none of the thermostat legs are placed adjacent the case. Thus, this means of frictionally holding the "stack" within the case is not possible. The indentation cannot be provided at a lower point in the "stack," as such as indentation would bear against a ceramic member, rather than the metal case, and provide the same dangers of cracking of the ceramic insulators.

BRIEF DESCRIPTION OF THE INVENTION

In accordance with the present invention, it has been discovered that an extra metallic piece can be added to the "stack," this extra metallic piece being provided with an indentation acting as a spring to frictionally hold the stack within the dead case. Because the indentation can be made to bear against the case, the problem of cracking of the ceramic is not present. The addition of this piece provides an adequate friction fit for use of the thermostat without an additional resinous material, if desired, or provides a sufficient hold so that the "stack" members are held in their proper positions during application of the resinous bonding material.

The extra metallic piece can also be formed so as to provide an additional function of holding a calibration pin in the proper position.

DESCRIPTION OF THE PREFERRED EMBODIMENTS

Figure 2:
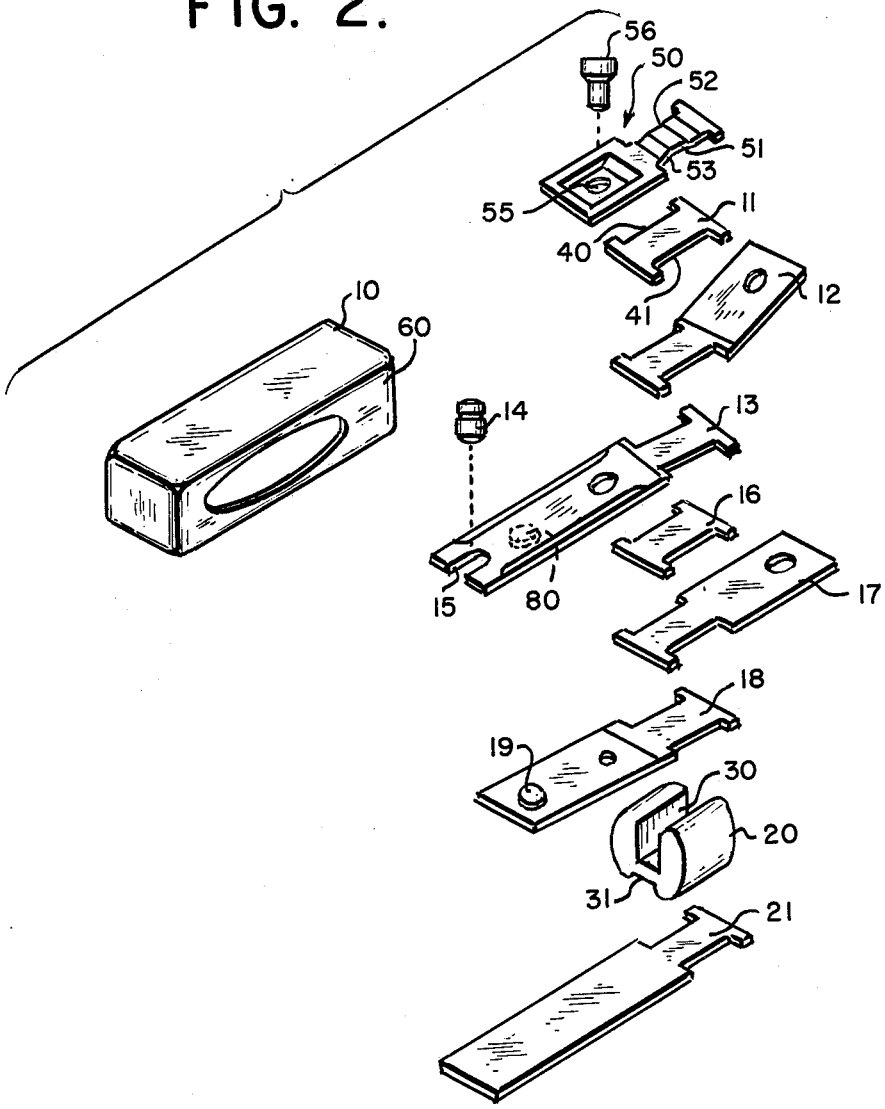
FIG. 2 is an assembly view, in perspective, showing the various parts of the thermostat, including the metallic piece formed with an indentation.

Referring to the accompanying drawings, and particularly to FIG. 2, the portions of a dead case thermostat are shown. They include a drawn steel case 10; an insulator-separator 11, formed of ceramic material; a quick connect 12, which provides one of the contacts at the outside of the thermostatic case; a stainless steel arm 13, having a contact 80, and with an insulator pin 14 formed for insertion into the opening 15 at one end of the stainless steel arm; another ceramic insulator-separator 16; a further quick connect 17, which forms the other contact on the outside of the case; a second stainless steel arm 18 having a contact member 19; a porcelain block insulator 20, having an upwardly opening channel; and a bimetallic actuator arm 21. It will be seen that the porcelain block insulator has an upper opening 30 into which the operating portions of the thermostat above it are placed, and a lower opening 31, into which the bimetallic arm 21 are fitted. Each of the pieces described, from the first insulator-separator 11 through the bimetallic thermostat 21, is provided with a recess on either side, such as illustrated by the numbers 40 and 41 for the insulator-separator 11, so as to fit and lock within the openings 30 and 31 formed in the porcelain block insulator 20.

In general, all of the pieces recited thus far are standard in the formation of dead case thermostats. In accordance with the present invention, an additional piece, 50, is added. This additional piece 50 will be referred to as a friction member and, while preferably made of stainless steel, can be made of any metal which is capable of being formed with an indented portion, such as illustrated at 51. As with the other members which go into forming the stack, the friction member 50 is provided with indented sections 52 and 53 which allow for it to be placed within the porcelain block insulator 20, particularly the opening 30 in that insulator, and held in place during insertion of the entire "stack" into the open end 60 of the case 10.

The specific form of the indentation on the friction member 50 is not critical. It can be, merely, a rounded bend in a narrowed portion of the friction member, as illustrated in FIG. 2, or can be a dimple formed in a similar portion of the friction member. Other forms of indentation will be apparent to those skilled in the art.

Figure 1:
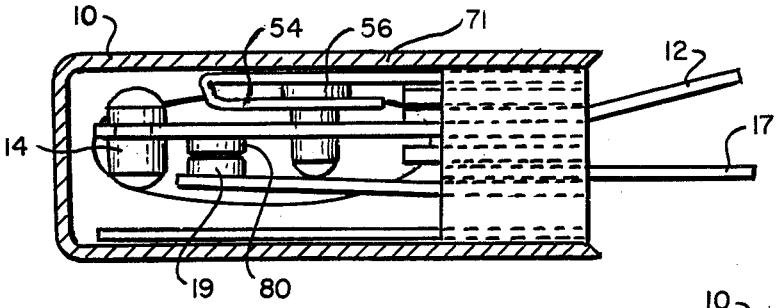
FIG. 1 is a sectional view of a fully assembled thermostat, with the indented metallic piece holding the "stack members" in place.
Figure 3:
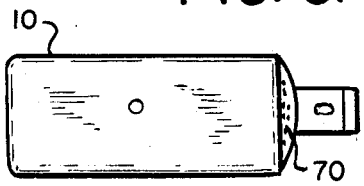
FIG. 3 is a plan view of an assembled thermostat, including an insulating resinous bonding material adjacent the opening of the thermostatic case.

As illustrated in FIGS. 1 and 2, the friction member 50 is formed with a lanced out section 54, the section 54 being provided with an opening 55. A calibration pin 56 is placed within the opening 55, prior to insertion of the stack into the case 10. The lanced section 54, and opening 55, are not required for the proper functioning of the present invention. The critical portion is the indentation, or bent portion, 51 though, as indicated, the friction member 50 can provide the dual function of aligning the calibration pin.

The opening 60 in the metal case 10 is sized so as to accommodate the width of the porcelain block insulator 20, and to just accept the height of the porcelain block insulator 20. The height of the porcelain block insulator is such as to accommodate each of the parts of the dead case thermostat such that, without the indentation 51, there is, essentially, a flush fit of the operating parts with the top and bottom of the porcelain block insulator 20. Thus, essentially, the bimetallic actuator arm 21 fully occupies the opening 31 provided at the bottom of the porcelain block insulator 20, while the stainless steel arm 50, in an unindented condition, the insulator-separator 11, the quick connect 12, the stainless steel arm 13, the insulator-separator 16, the quick connect 17, and the stainless steel arm 18 fit flush with the top of the porcelain block insulator 20 within the opening 30. The indentation 51 is so sized as to make the "stack" slightly larger than the height of the opening 60 in the case 10.

It is important that the indentation be convex toward the upper portion of the case 10, so that the pressure is applied against the metallic case, and not against the ceramic insulating members placed below the stainless steel arm 50. As indicated, if the indentation were convex downwardly, the same problems would be provided as with attempting to crimp the case, or to employ a precrimped case. By facing the convex section of the stainless steel arm upwardly, the pressure is applied against the case, and no undue stress is placed upon the ceramic members.

When the "stack," with the stainless steel arm 50 in place, is placed within the case, the indentation is sufficient to hold the parts in their assembled, and operating, condition within the case. If desired, an insulating resin, such as an epoxy 70, may be applied across the entire opening of the case to provide additional insulation and, in addition, to bond the operating members in place within the case.

In the embodiment illustrated in FIGS. 1 and 2, the calibration pin 56 is held upright within the opening 55 formed in the lanced section 54 of the stainless steel arm 50. The enlarged end of the calibration pin bears against the upper surface 71 of the case 10. The device can then be calibrated by crimping adjacent the calibration pin 56 on the upper surface 71. This crimping does not provide the danger of breakage of the ceramic insulators, as the pressure of the crimp is not applied against any of the ceramic parts of the device.

With the device assembled, and calibrated as illustrated, the thermostat can be attached in a line, as with any standard thermostat, employing the exposed contacts 12 and 17.

A construction has thus been shown to allow for insertion of a stack of operating portions of a thermostat into a dead case thermostat, and providing a frictional fit for the operating members, without danger of cracking ceramic insulating members. The construction has been illustrated with a porcelain block insulator 20 having an upper channel, such as opening 30, as well as a lower opening 31. The present invention is equally applicable, obviously, to the U-shaped member described and claimed in the afore-referenced U.S. Pat. No. 3,223,809.

Further, while the section 54 has been shown as a lanced out member, it can equally well be formed as a reverse section. It is only important that a displayed arm on the friction member 50 be provided and, for savings in assembly and formation, this arm should be an integral part of the friction member 50, rather than being a separate member.

While specific embodiments have been shown and described, the invention should not be considered as limited to this embodiment, but only as limited by the appended claims.

I claim:

1. In a dead case thermostat having operating members including a bimetallic actuator, contact arms, connector members, and insulators held within a ceramic block insulator, the improvement which comprises a spring member placed within the block insulator, in a position to bear directly against the case into which the block insulator, with the operating members in place, is inserted, whereby the operating members of the thermostat are held in place within the case by a friction fit.

2. The thermostat of claim 1 wherein the spring member is a metallic plate having an indentation formed in it, said indentation having convex and concave portions, the convex portion of the indentation being adjacent the case.

3. The thermostat of claim 2 wherein the spring member is formed of stainless steel.

4. The thermostat of claim 2 wherein the indentation is in the form of a bend in a narrowed portion of the metallic plate.

5. The thermostat of claim 1 wherein the spring member is formed of stainless steel.

6. The thermostat of claim 1 wherein the spring member is a metallic plate having an additional, integral arm, said arm being below the main metallic plate, said arm having means for holding a calibration pin.

7. The thermostat of claim 6 wherein the additional arm is a lanced out section.

* * * * *